US011186056B2

(12) United States Patent
Krieger

(10) Patent No.: US 11,186,056 B2
(45) Date of Patent: Nov. 30, 2021

(54) MECHANICAL PRESS WITH SLIDING BLOCK

(71) Applicant: SMS group GmbH, Düsseldorf (DE)

(72) Inventor: Wilhelm Krieger, Odenthal (DE)

(73) Assignee: SMS group GmbH, Düsseldorf (DE)

( * ) Notice: Subject to any disclaimer, the term of this patent is extended or adjusted under 35 U.S.C. 154(b) by 427 days.

(21) Appl. No.: 15/775,940

(22) PCT Filed: Nov. 10, 2016

(86) PCT No.: PCT/EP2016/077223
§ 371 (c)(1),
(2) Date: May 14, 2018

(87) PCT Pub. No.: WO2017/084952
PCT Pub. Date: May 26, 2017

(65) Prior Publication Data

US 2018/0326683 A1 Nov. 15, 2018

(30) Foreign Application Priority Data

Nov. 20, 2015 (DE) ..... 10 2015 222 994.7
Nov. 20, 2015 (DE) ..... 10 2015 222 995.5

(51) Int. Cl.
*B30B 1/26* (2006.01)
*B30B 15/06* (2006.01)
(Continued)

(52) U.S. Cl.
CPC ..... *B30B 1/266* (2013.01); *B30B 1/26* (2013.01); *B30B 1/40* (2013.01); *B30B 15/0035* (2013.01); *B30B 15/068* (2013.01)

(58) Field of Classification Search
CPC . B30B 15/0035; B30B 15/068; B30B 15/041; B30B 1/26; B30B 1/266
See application file for complete search history.

(56) References Cited

U.S. PATENT DOCUMENTS 3,122,033 A * 2/1964 Riemenschneider ..... B30B 1/40 72/427
3,358,591 A * 12/1967 Bradlee ..... B30B 1/261 100/257
(Continued)

FOREIGN PATENT DOCUMENTS

DE 1627435 A1 1/1970
DE 2361521 A1 7/1974
(Continued)

OTHER PUBLICATIONS

International Search Report dated Mar. 16, 2017 of corresponding International Application No. PCT/EP2016/077223; 7 pgs.

*Primary Examiner* — Jimmy T Nguyen
(74) *Attorney, Agent, or Firm* — Maier & Maier, PLLC

(57) ABSTRACT

A mechanical press, with at least one drive shaft having a driver that is eccentric with respect to a shaft axis, and a sliding block. The sliding block is driven by the driver to perform a forcibly guided movement. During an execution of a pressure stroke, the sliding block is guided on at least one sliding surface on the pressure-input side opposite to a pressure-input-side surface of a slide guide. The sliding block has a sliding surface on the pressure-output side lying opposite to the pressure-input side surface, this surface being guided on a pressure-output-side surface of the slide guide, wherein the sliding surface on the pressure-input side of the sliding block has a concave or convex curvature. The sliding surface on the pressure-output side of the sliding block has the opposite concave or convex curvature, respectively.

17 Claims, 8 Drawing Sheets

(51) Int. Cl.
*B30B 15/00* (2006.01)
*B30B 1/40* (2006.01)

(56) References Cited

U.S. PATENT DOCUMENTS

| | | | | |
|---|---|---|---|---|
| 3,521,475 | A | 7/1970 | Bothe | |
| 3,871,223 | A | 3/1975 | Kralowetz et al. | |
| 5,315,926 | A | 5/1994 | Kanamaru et al. | |
| 5,609,056 | A * | 3/1997 | Seeber | B21J 9/18 100/257 |
| 5,666,838 | A * | 9/1997 | Dudick | B21J 3/00 72/14.8 |
| 2004/0050262 | A1 * | 3/2004 | Kanamaru | B30B 1/266 100/282 |
| 2005/0022679 | A1 | 2/2005 | Kanamaru et al. | |
| 2009/0217724 | A1 | 9/2009 | Bosga et al. | |
| 2013/0074710 | A1 | 3/2013 | Kuboe et al. | |

FOREIGN PATENT DOCUMENTS

| | | | | |
|---|---|---|---|---|
| JP | S49-109249 | A | 10/1974 | |
| JP | 55048500 | A * | 4/1980 | B30B 1/16 |
| JP | H05-309493 | A | 11/1993 | |
| JP | 2001-286950 | A | 10/2001 | |
| JP | 2004-114119 | A | 4/2004 | |
| JP | 2004-136336 | A | 5/2004 | |
| JP | 2007-275904 | A | 10/2007 | |
| JP | 2008-100278 | A | 5/2008 | |
| JP | 2009-525879 | A | 7/2009 | |
| JP | 2011-031299 | A | 2/2011 | |
| JP | 2011079034 | A * | 4/2011 | B30B 1/16 |
| JP | 2013-027910 | A | 2/2013 | |
| JP | 2013-071123 | A | 4/2013 | |
| JP | 2015-030037 | A | 2/2015 | |
| SU | 1289699 | A1 * | 2/1987 | B30B 1/26 |
| WO | 2007/091935 | A1 | 8/2007 | |

* cited by examiner

MECHANICAL PRESS WITH SLIDING BLOCK

FIELD

The invention relates to a mechanical or path-controlled press.

BACKGROUND

DE-OS-1 627 435 describes a forging press, in which an eccentric of a drive shaft engages in an opening of a sliding block. The sliding block is braced by an upper, convex side and by a lower, convex side, respectively, against a corresponding concavely shaped surface of a slide guide. In the course of one revolution of the drive shaft, the sliding block swings about a pendulum axis that extends through a lower region of the sliding block.

WO 2007/091935 A1 describes a drive system for a press, in which a first motor drives a flywheel that can be coupled to the press, and in which a second motor is also provided for the drive system of the press.

SUMMARY

The object of the invention is to provide a mechanical press in which an optimized force vs. path curve is given.

Thanks to the concave or convex shaping of the pressure-input-side sliding surface, a force transmission by the sliding block can be achieved in a simple way, this transmission corresponding to a slider-crank mechanism. At the same time, a large bearing surface is obtained in the region of the sliding surface, so that a design for large pressing forces can be easily achieved.

In particular, the pressure-input side, concave curvature and the pressure-output side, convex curvature may each be formed as a circular arc. The curvatures are preferably arranged concentrically about the same point, through which also runs a pendulum axis of the sliding block. The two sliding surfaces thus form forcibly guiding slide guide surfaces of a slide guide mechanism for the sliding block.

In a first variant of the invention, the sliding block has the concave sliding surface on the pressure-input side and the convex sliding surface on the pressure-output side. This corresponds to the kinematics of a slider-crank mechanism, in which the dead center of a working stroke or pressing process is present in an extended position of the slider-crank mechanism.

In a second variant of the invention, the sliding block has the convex sliding surface on the pressure-input side and the concave sliding surface on the pressure-output side. This corresponds to the kinematics of a slider-crank mechanism, in which the dead center of a working stroke or pressing process is present in a coincident position of the slider-crank mechanism.

By a sliding block is meant in the sense of the invention an element which can move in forcible guidance opposite to a slide guide surface. The slide guide surface comprises in particular the pressure-input-side surface and the pressure-output-side surface for the guidance of the sliding block.

By a driver is meant in the sense of the invention, for example, an eccentric or a crank pin. In the interest of a large force transmission, the driver is preferably an eccentric of the drive shaft, which runs, for example, with a circular circumference in an opening of the sliding block.

By a slide guide is meant in the sense of the invention a movable component of the press, which takes up a working pressure from the sliding block during a pressure stroke or reshaping process and passes it on. In principle, the slide guide may be formed as a common structural component with a ram of the press. In other embodiments, however, another mechanism of any structural kind, for example, a wedge deflection, may be provided between the slide guide and the ram. In the region of the force uptake in the pressing direction, the slide guide preferably has a pressure piece that has optimized material properties for abutment against the sliding block.

A press in the sense of the invention generally involves a press for forging, punching, deep drawing, or any other reshaping process for which mechanical presses are used.

The design of a mechanical press according to the invention generally makes possible a low structural height. This results in shorter spring lengths for the uprights, ram, and/or slide guide of the press. In this way, the rigidity is improved when compared to traditional eccentric presses with the same upright design.

Moreover, the design according to the invention makes possible an especially long length of a rigid unit composed of slide guide and ram for a given structural height of the press. This allows an especially good lateral guidance of the ram and the rigid unit, even under large pressing forces.

In general, it is advantageously provided that the sliding block executes a pendulum movement about a pendulum axis, wherein the pendulum axis is situated outside the sliding block. In general, the pendulum axis is preferably disposed fixed in place relative to the slide guide. Assuming a linear forced guidance of the slide guide, the sliding block then provides a transfer of motion relative to the pendulum axis or relative to the slide guide in the manner of a slider-crank mechanism. In the sense of the invention, depending on the requirements, another forced guidance of the slide guide is also conceivable, so that the kinematics of a slider-crank mechanism is only one of various possible transfers of motion. The invention is not limited to the specifically described variants of slider-crank mechanisms.

In a preferred enhancement, it is proposed that the driver travels about an eccentric axis in the sliding block, wherein the eccentric axis has a spacing R relative to the shaft axis, while the eccentric axis has a spacing L relative to the pendulum axis, and wherein: L:R>=4. Furthermore, especially preferably, 12>=L:R>=5. For a linear guidance of the slide guide, accordingly, the quantities R and L denote the characterizing quantities of the push rods of an analogous slider-crank mechanism, and, in an analogous slider-crank mechanism, the quotient R:L corresponds to the push rod ratio lambda (or L:R=1/lambda). Such a design of the mechanism of the press according to the invention allows a large ratio between a pressing force acting in a guiding direction of the pressure piece and a normal force acting perpendicular to it. A certain normal force is desirable in order to assure a good abutment of the slide guide and/or the ram against a lateral guide. By combination with the use of a sliding block, a large inverse push rod ratio 1/lambda is made possible, without the need for the structural height of the press to become larger. Thanks to the above-mentioned features, even with low structural height and correspondingly good rigidity, one may achieve similar pressure dwell times (characteristic: lambda) to those of traditional eccentric presses with push rods.

In the first variant, analogous to the extended position of a slider-crank mechanism, the pendulum axis is situated on the side of the pressure-input direction relative to the shaft axis. The pressure dwell time here, for the same cycle time, is equal to that of traditional presses with push rods. In the second variant, similar to the coincident position of a slider-crank mechanism, the pendulum axis is situated on the side of the pressure-output direction relative to the shaft axis. In this case, the pressure dwell time for the same cycle time is larger than that of traditional presses with push rods, but this may be of advantage in the case of special reshaping methods or materials.

In a generally preferred enhancement of the invention, an adjusting element, especially one in the form of an adjustably rotatable eccentric ring, is arranged between the driver and the sliding block. Such an adjusting element may be used, for example, to adjust the height of a ram.

In one preferred embodiment of the invention, the slide guide is moved during the pressure stroke substantially in a line with a ram of the press. This corresponds to a linear and direct transmission of the pressing force.

In an alternative embodiment of a press according to the invention, a force deflection occurs between the slide guide and a ram of the press. Preferably, the force deflection may occur by means of a wedge. In this way, the general advantages of a wedge press may be combined with the advantages of a press according to the invention.

In a generally advantageous enhancement of the invention, there is provided an ejecting mechanism which is stationary relative to the slide guide and has an ejector which is movable relative to the slide guide and acts on a workpiece, wherein the ejecting mechanism is activated by the movement of the sliding block. This enables a simple and effective ejecting of a workpiece after a pressing process. More preferably, such an ejecting mechanism is combined with a sliding block of the second embodiment, in which a convex sliding surface is present at the pressure-input side. This means, for otherwise the same dimensioning, a longer path of the sliding block in the region of the pressure-side sliding surface, which allows an especially simple and effective transfer of motion to the ejector. The activating of the ejector may occur, for example, by a ramp, cam, or similar structure formed on the sliding block, which activates the ejector upon reaching a corresponding position of the drive shaft against a restoring spring force.

In a preferred detail configuration, a mechanism may be arranged between the sliding block and the ejector, so that the force and motion sequence of the ejector are further optimized. In particular, the mechanism may be, for example, a steering mechanism, a deflecting lever or the like.

In a generally preferred embodiment of the invention, it is provided that a drive system of the drive shaft comprises a first motor, a flywheel driven by the first motor, and a second motor, wherein the flywheel can be detachably coupled to the drive shaft by means of a coupling, and wherein the drive shaft can be driven via the second motor. Such an embodiment of the press drive enables an especially low design of the drive, wherein for example relatively small flywheel diameters can be used. This allows an ideal combination with a force transmission by means of a sliding block, since such force transmission can likewise be realized with low structural height.

The first motor serves substantially to drive the flywheel and to supply at least some of the energy removed from the flywheel. The second motor serves substantially to speed up and/or slow down the drive shaft when it is decoupled from the flywheel, in a state decoupled from the flywheel. Furthermore, the second motor may serve to introduce additional drive energy even in the decoupled state. The energy of deceleration occurring upon deceleration may be fed by inverter to the first motor in one possible detail design. In the sense of the present invention, motors are to be understood as electric motors each time.

In a preferred enhancement, the coupling is engaged in a normal operating mode when a drive-side and an output-side rotational speed at the coupling are at least approximately equal, wherein an equalizing of the rotational speeds occurs by a definite actuation of the second motor. This allows a substantial reduction of wear on the coupling.

In the interest of a simple and space-saving design, the first motor and the flywheel may be arranged coaxially to one another. Preferably, they are integrated as a structural unit in a flywheel motor. Such a flywheel motor advantageously dispenses with a bulky belt drive plus an additional motor bracket. In another possible embodiment, the motor and the flywheel are arranged coaxially to one another and they are preferably joined together by a gearing, preferably a planetary gearing, so that depending on the requirements it is also possible to realize up-gearing. This can make possible especially small flywheel masses.

It is generally advantageous that the flywheel can be coupled to the drive shaft without gearing up, wherein the flywheel is arranged, in particular, concentric to the drive shaft.

Such a simple design with no countershaft can be especially advantageously integrated when the flywheel can be designed with sufficiently small diameter. This, in turn, is made possible by the drive concept according to the invention.

To avoid expensive gearings and in the interest of a compact design, in one preferred embodiment, the second motor is designed as a torque motor arranged concentric to the drive shaft. By a torque motor is meant generally and in the sense of the invention a heavy-torque, high-pole motor, generally running by way of a hollow shaft. Torque motors furthermore have a high torque even from standstill.

Especially advantageously, a brake of the drive shaft may be provided, concentric to the torque motor and overlapping in the axial direction with the torque motor. In particular, in this case, the brake may be placed in the region of a hollow shaft of the torque motor, so as to also utilize this design space. The brake may be a mechanical brake for generating heat of friction or also an electrical regenerative brake.

The brake may be a holding brake to secure a standstill when the press is not in operation. More preferably, it may be a spring-loaded brake, which can be pneumatically released and hydraulically and/or electromagnetically engaged.

In general, it is advantageously provided that the drive shaft, starting from a resting start position, passes through an angle of rotation of more than 360° by way of the pressure stroke, up to a resting stop position. Especially advantageously, the angle of rotation is between 370° and 450°. This enables a larger acceleration path before the actual pressing process or a larger braking path after the actual pressing process, so that the corresponding motors and brakes may be dimensioned accordingly smaller. This particularly applies to the second motor.

On the whole, a drive as described above makes possible a high power. In this way, with a given charging time, a large drop in rotational speed can be recharged. A high permissible drop in rotational speed permits a small flywheel, which is of advantage.

In order to avoid contamination of a work zone with lubricating grease, it may be advantageous to lubricate a main bearing site of the drive shaft by means of a circulating oil lubrication.

Further benefits and features will emerge from the following described exemplary embodiments.

BRIEF DESCRIPTION OF THE DRAWINGS

Preferred exemplary embodiments of the invention shall now be described and explained with the aid of the enclosed drawings.

DETAILED DESCRIPTION

Figure 1:
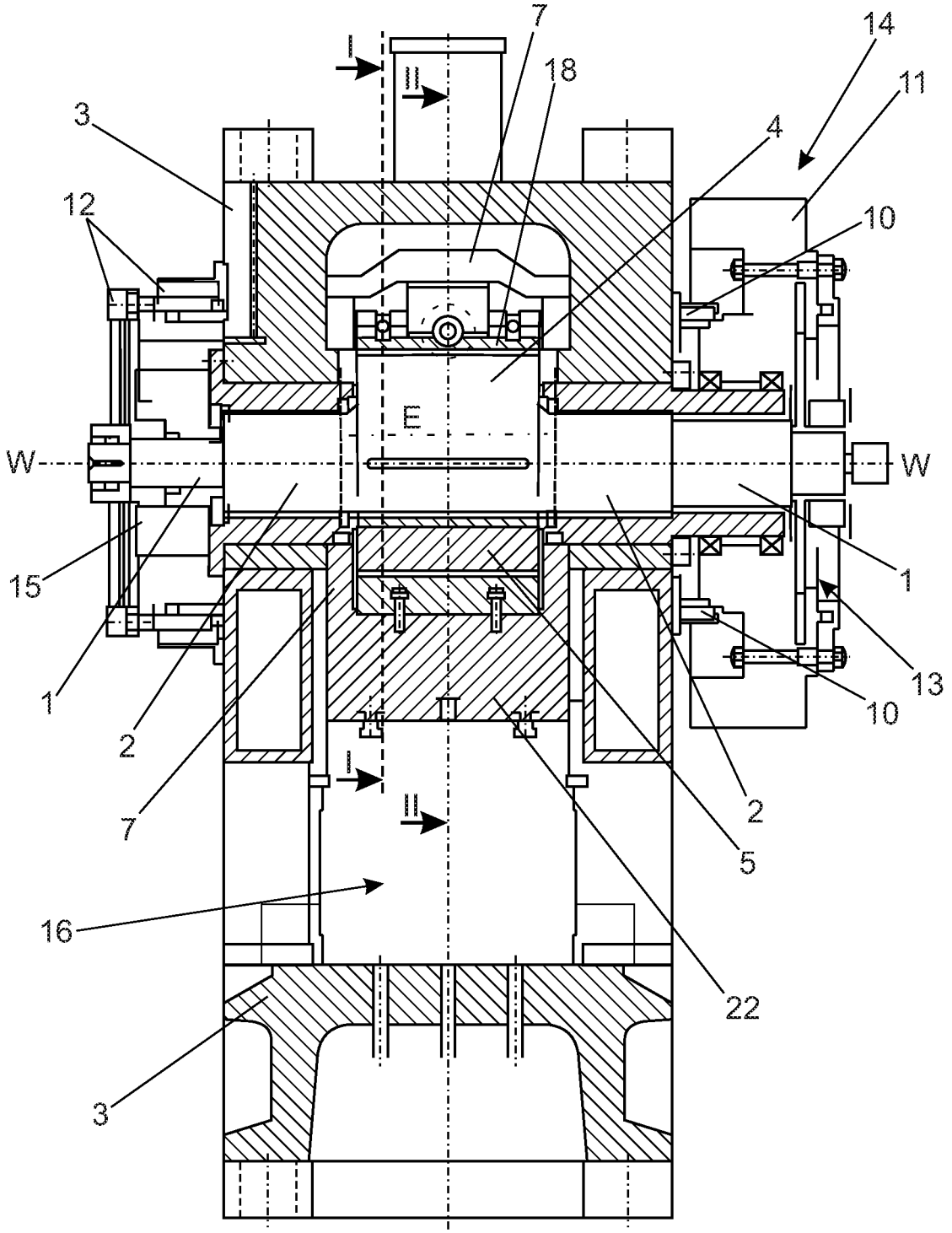
FIG. 1 shows a schematic cross-sectional view of a first exemplary embodiment of a mechanical press according to the invention, wherein the sectioning plane runs parallel to a drive shaft.

The mechanical press of the invention according to the exemplary embodiment of FIG. 1 comprises a drive shaft 1 with a shaft axis W, which is rotationally mounted in two main bearings 2 opposite a press frame 3. The main bearings 2 preferably have a circulating oil lubrication.

Between the main bearings 2, the drive shaft 1 has an eccentric driver in the form of an eccentric 4. The eccentric 4, which is circular in cross section has an eccentric axis E, which is set off by a radial spacing R from the shaft axis W.

The eccentric 4 engages with a sliding block 5 in a borehole 6 corresponding to the diameter of the eccentric. For assembly purposes, the sliding block is thus composed of several parts.

For its part, the sliding block 5 is guided in a slide guide 7. The slide guide 7 is fashioned as a housing that is movable relative to the press frame 3. The slide guide 7 comprises a pressure piece 8 on a pressure-input side, on which a pressure-input-side sliding surface 8*a* is fashioned. On an opposite side relative to the sliding block, a pressure-output-side sliding surface 7*a* is fashioned on the slide guide.

The sliding block 5 has a pressure-side sliding surface 5*a*, which lies against the sliding surface 8*a* of the pressure piece 8, as well as a pressure-output-side sliding surface 5*b*, which lies against the pressure-output-side sliding surface 7*a* of the slide guide 7.

The pressure-input-side sliding surface 5*a* is formed concave on the sliding block 5. The pressure-output-side sliding surface 5*b* is formed convex on the sliding block 5. The sliding surfaces 5*a*, 5*b*, 7*a*, 8*a* are formed each time as sections of a cylinder envelope surface, the cylinder axes running parallel to the shaft axis W. The sliding surfaces 5*a*, 5*b*, 7*a*, 8*a* run concentrically about a pendulum axis P of the sliding block 5 which is parallel to the shaft axis W. In other words, the cylinder axes of the cylinder envelope surfaces, of which the sliding surfaces 5*a*, 5*b*, 7*a*, 8*a* form sections thereof, coincide with the pendulum axis P.

The pendulum axis P thus lies at the pressure-input side and outside the sliding block in the first variant of the sliding block described here, since the pressure-side sliding surface 5*a* of the sliding block 5 is formed concave. Upon rotation of the drive shaft 1, there results for the sliding block 5 a forcibly guided pendulum movement about the pendulum axis P.

The pendulum axis P is fixed in space relative to the slide guide 7 or the pressure piece 8. The slide guide 7 and the pressure piece 8 provided on it are held by way of lateral guides 9, in which they can move in linear manner in a direction perpendicular to the shaft axis W. A pressure stroke is executed by a downward movement in regard to the representation in FIG. 2, during which the driving force of the drive shaft 1 acts on the pressure piece 8 by way of the sliding block 5. After a bottom dead center of the movement, the driving force of the drive shaft 1 acts on the pressure-output-side sliding surface 7*a* of the slide guide 7 by way of the sliding block 5, so that slide guide 7 and pressure piece 8 are brought back counter to the pressure stroke direction.

On a bottom side of the slide guide 7 in the present case, there are arranged clamping devices 7*b*, by which a ram of the press and/or a tool holder and/or a tool may be attached. These perform correspondingly identical movements to the slide guide 7 and the pressure piece 8.

Through the guides 9, the slide guide 7 and the pressure piece 8 (or a ram or tool of the press) execute a movement analogous to that of a slider crank drive. An example of a slider crank drive is the transmission of motion between piston and crankshaft in a traditional internal combustion engine.

The characterizing quantities for the motion in this case are the radial spacing R, on the one hand, and a spacing L between the pendulum axis P and the eccentric axis E. The ratio R:L corresponds in the case of the traditional slider crank drive to the push rod ratio lambda. Given constant angular velocity of the drive shaft 1, a greater ram velocity will occur when R and L stand at a right angle to each other.

In the present example, the dead center of the working stroke corresponds to an extended position of an analogous slider crank mechanism. That is, the distances R and L at the lowermost point of the tool are collinear and lie one behind the other. The dead center of the working stroke is also designated as the bottom dead center.

By contrast with a pure sinusoidal drive (e.g., sliding bock sliding horizontally in the slide guide with a flat pressure-side sliding surface), a greater ram velocity occurs only 90° after OT (top dead center).

In the present case, the reciprocal 1/lambda=L:R is used in order to optimize the drive of the press according to the invention. It has been determined that a forging press is designed especially advantageously in a range of L:R=8 in regard to the requirements of the motion sequence as well as the pressing forces occurring on the lateral guides 9. In general, the ratio 4<=L:R is preferred. Especially preferred, one should have 5<=L:R<=12.

Such relatively large inverse push rod ratios have practically no impact on the structural height of a press of the present kind, since the position of the pendulum axis P is defined only by the movement of the sliding block and no particular shaft or mounting is required in this position.

Figure 4:
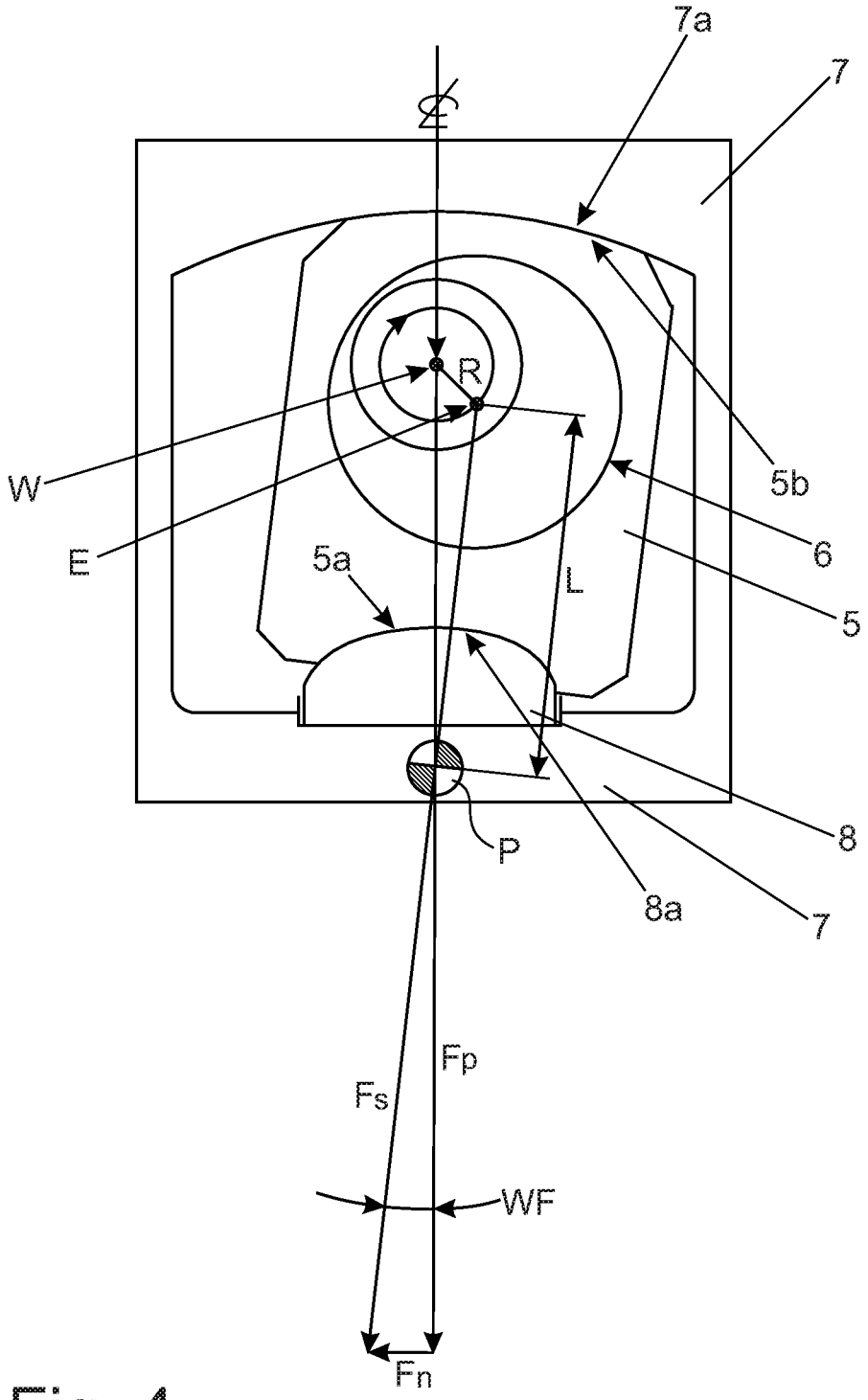
FIG. 4 shows a sketch of a sliding block drive as a detail of the press from FIG. 1.

The above described mounting and movement of the sliding block is further explained in FIG. 4. Force vectors Fs, Fp and Fn are furthermore drawn, having the following meaning:

Fs is the overall pressure force exerted by the sliding block 5. Fs lies on a line which runs perpendicular through the eccentric axis E and the pendulum axis P.

Fp is the force component of Fs, acting in the direction of the pressure stroke and on the workpiece. In the specific model of the press in FIG. 1, it is the vertical force component.

Fn is the force component of Fs standing perpendicular to Fp and also perpendicular to the guides 9 or the direction of the pressure stroke. The behavior of the moving parts in the guides 9 is definitively determined by Fn.

Any angle WF between Fp and Fs expresses the crank angle and the ratio L:R. Based on the chosen ratio L:R, the angle WF is relatively small in the present example of a press.

A drive of the press according to the invention will be described below.

A drive of the drive shaft 1 comprises a first motor 10, a flywheel 11 that can be driven by the first motor 10 and a second motor 12. The flywheel 11 may be coupled detachably via a coupling 13 to the drive shaft 1. The second motor 12 drives the drive shaft 1 directly. In one possible operating mode, a deceleration or braking of this drive system occurs in particular not via a brake, but via the second motor 12.

In the present case, the flywheel 11 and the first motor 10 are combined into a structural unit in the form of a flywheel motor 14. The first motor 10 and the flywheel 11 here are arranged coaxially to each other and to the shaft axis W of the drive shaft 1. Motor 10 and flywheel 11 are directly joined together. No transmission occurs here, such as by means of a gearing or a belt drive. In other embodiments, not shown, a transmission may be provided between flywheel and first motor, for example by means of a planetary gearing.

The coupling 13 is arranged directly on the flywheel motor 14 and is likewise situated in a concentric or coaxial position on the shaft axis W. Flywheel motor 14 and coupling 13 are arranged at the same end—of two ends—of the drive shaft 1.

The second motor 12 is arranged at the second end of the drive shaft 1, lying opposite to the main bearing 2. The second motor 12 is also positioned coaxially to the shaft axis W via the drive shaft 1. It drives the drive shaft directly and with no transmission. For this, the second motor 12 is designed as a torque motor. The second motor 12 accordingly has a high torque even from standstill.

A brake 15 of the drive system is positioned concentrically and overlapping in axial direction with the second motor 12. In particular, the brake is positioned predominantly in a hollow shaft of the second motor 12, so that it makes optimal use of the design space. By means of the brake 15 braced against the press frame, when needed, the drive shaft 1 can be braked with high power and/or be brought to a standstill. The brake may be designed as an electrical regenerative brake and/or as a mechanical brake generating frictional heat. In the present instance, the brake 15 is preferably spring-loaded and serves in one possible operating mode as a safety element during standstill of the press. It may be pneumatically released and hydraulically and/or electromagnetically engaged.

Figure 2:
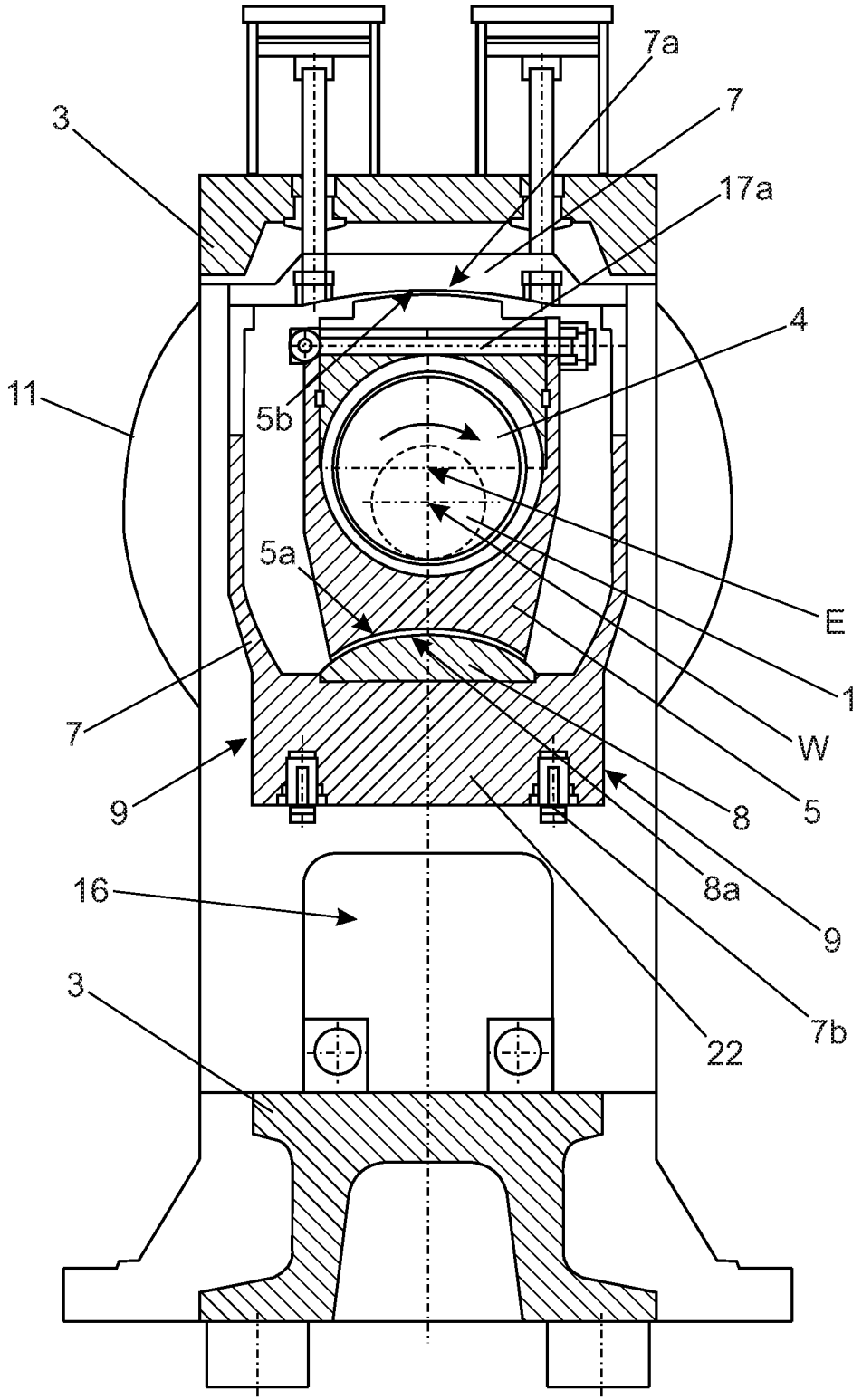
FIG. 2 shows the press from FIG. 1 in a cross-sectional view with sectioning plane along line I-I running perpendicular to the drive shaft.

In particular, the view of FIG. 2 makes it clear that the flywheel 11 has a sufficiently small diameter so as not to overlap in height with a work zone 16 of the press. This enables optimal access to the work zone 16.

Now, the above-described drive system functions as follows:

In general, the flywheel 11 is maintained permanently by the first motor 10 at a desired rotational speed. The second motor 12 serves to accelerate the drive shaft 1 prior to a pressing run from a resting start position to a rotational speed equal or at least approximately equal to the flywheel, while the coupling 13 is still disengaged. When the rotational speed difference is sufficiently small, the coupling 13 is then engaged or closed, so that accordingly, little or no friction loss occurs on the coupling. Accordingly, the coupling is dimensioned relatively small.

By the following pressure stroke and reshaping process of a workpiece, the drive shaft 1 is braked and energy is withdrawn from the flywheel 11. At the same time, the first motor 10 and the second motor 12 work together with high power in order to compensate at least partly for the withdrawal of energy. In this way, the flywheel is dimensioned relatively small.

After the pressure stroke or reshaping process, the drive shaft 1 is once more decoupled from the flywheel 11. With the aid of the brake 15, possibly also by reversal of the second motor 12, the drive shaft 1 is then brought to a standstill.

Especially preferred, an electronic control system of the press is designed such that, starting from the resting start position, the drive shaft 1 passes through an angle of rotation of more than 360° by way of the pressure stroke/reshaping process up to the resting stop position. Preferably, the angle of rotation is between 370° and 450°.

In the present example, the angle of rotation is around 390°. For this purpose, prior to an acceleration in the working direction, the drive shaft is reversed by the second motor 12 at first by around 30° opposite the working direction, i.e., 30° before the top dead center. In itself, this causes no collision or impairment of the work zone 16, but it significantly enlarges the available angle of acceleration for the subsequent rotation of the drive shaft in the working direction. In this way, the second motor 12 can be designed relatively small.

Figure 3:
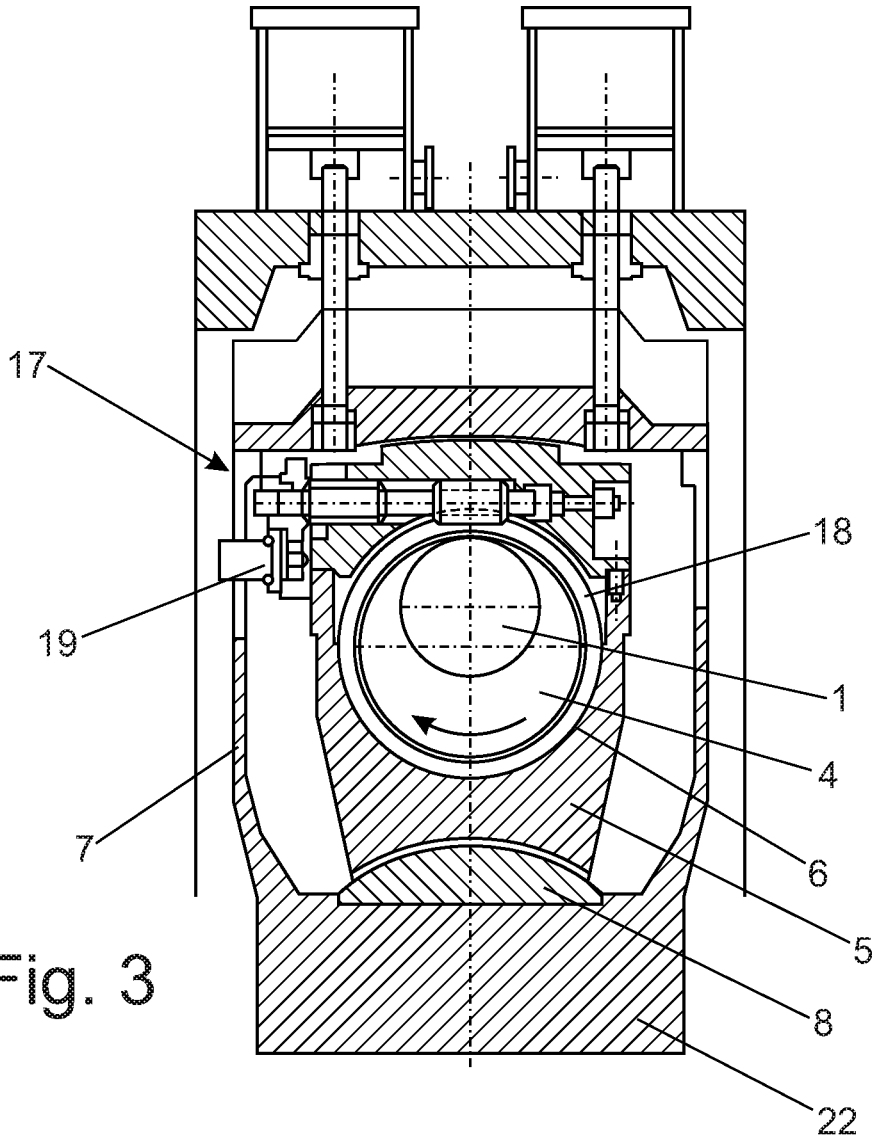
FIG. 3 shows a cross-sectional view along line II-II of the press from FIG. 1 with an adjusting element.

FIG. 3 shows the press of FIG. 1 in a cross-sectional view with sectioning plane II-II running perpendicular to the drive shaft. An adjusting element 17 is provided, by means of which a height of the sliding block 5 can be adjusted. This adjustment can also be carried out during operation. In one possible operating mode, the adjustment can be conducted stepwise between two consecutive strokes.

The adjusting element 17 comprises an eccentric ring 18, which is arranged between the borehole 6 in the sliding block 5 and the eccentric 4 of the drive shaft 1. The eccentric ring 18 may be rotated in its seat by an actuator 19, so that the borehole accommodating the eccentric 4 changes its position relative to the sliding block 5.

FIG. 2 shows a clamping 17*a* of the adjusting element 17. The clamping 17*a* may be hydraulically released. The engaging of the clamping 17*a* may occur hydraulically or mechanically (self-locking), or by a hydraulic and mechanical combination.

Figure 5:
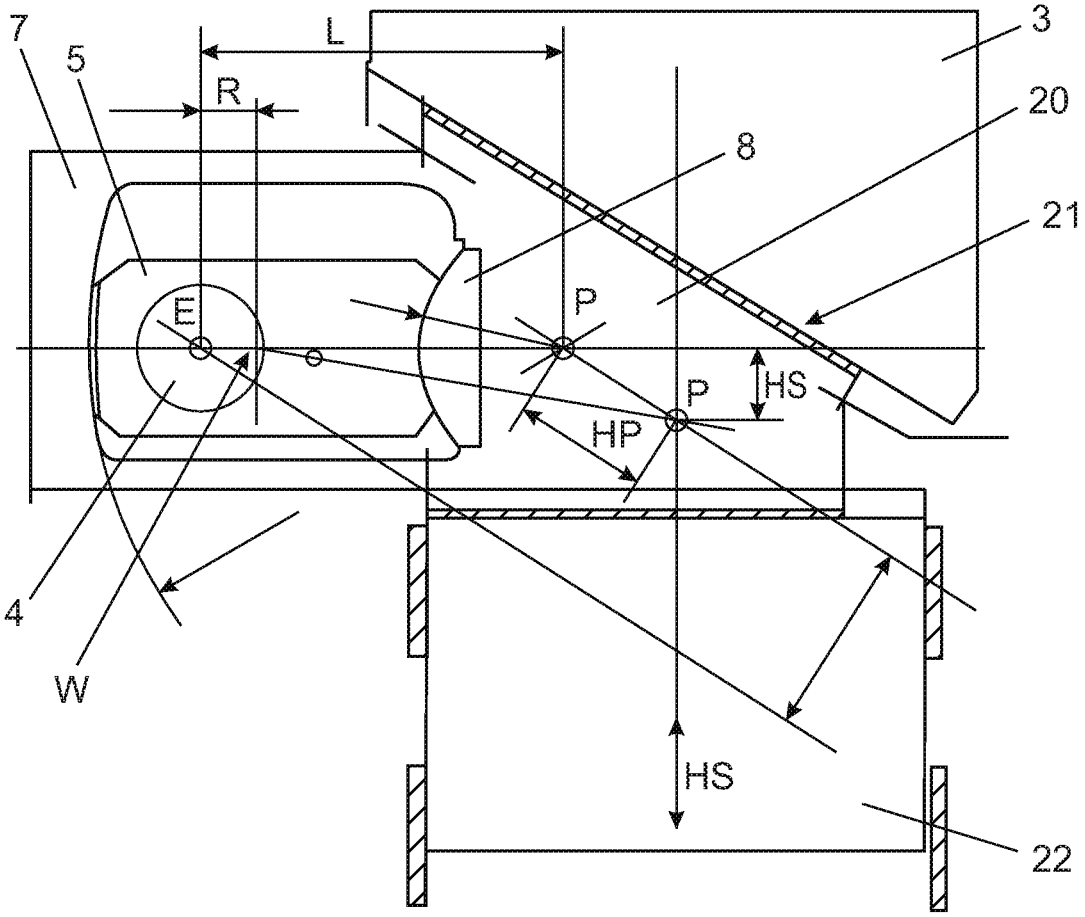
FIG. 5 shows a sketch of a second exemplary embodiment of the invention with a sliding block drive and a wedge drive combined with it.

FIG. 5 shows a second embodiment of a press according to the invention. Here, a ram and/or tool of the press is not advanced directly by the slide guide 7 in linear manner. Instead, a force deflection is provided between the pressure piece and a ram of the press. In the present case, the force deflection occurs by means of a wedge 20, which can be shifted opposite to a support surface 21 fixed to the frame and inclined with respect to the direction of the pressure stroke. The wedge 20 in the present case is firmly connected to the slide guide 7. A ram 22 of the press lies movably against a side of the wedge 20 lying opposite to the support surface 21.

Viewed analogously to a simple slider crank drive, it must be noted that the pendulum axis P is displaced in the course of the transmission of motion in parallel with the support surface 21. Accordingly, in the sense of the invention, the pressure stroke HP is viewed as running in the direction of this offset.

Accordingly, a movement HS of the ram 22 of the press is deflected in the present instance by around 120° to the pressure stroke HP of the slide guide 7. With such a wedge drive, a particularly uniform force distribution can be achieved over the width of the ram.

With respect to the design of the drive system of the press or the design and transmission of motion of the sliding block, the second exemplary embodiment has no changes relative to the example of FIG. 1.

Figure 6:
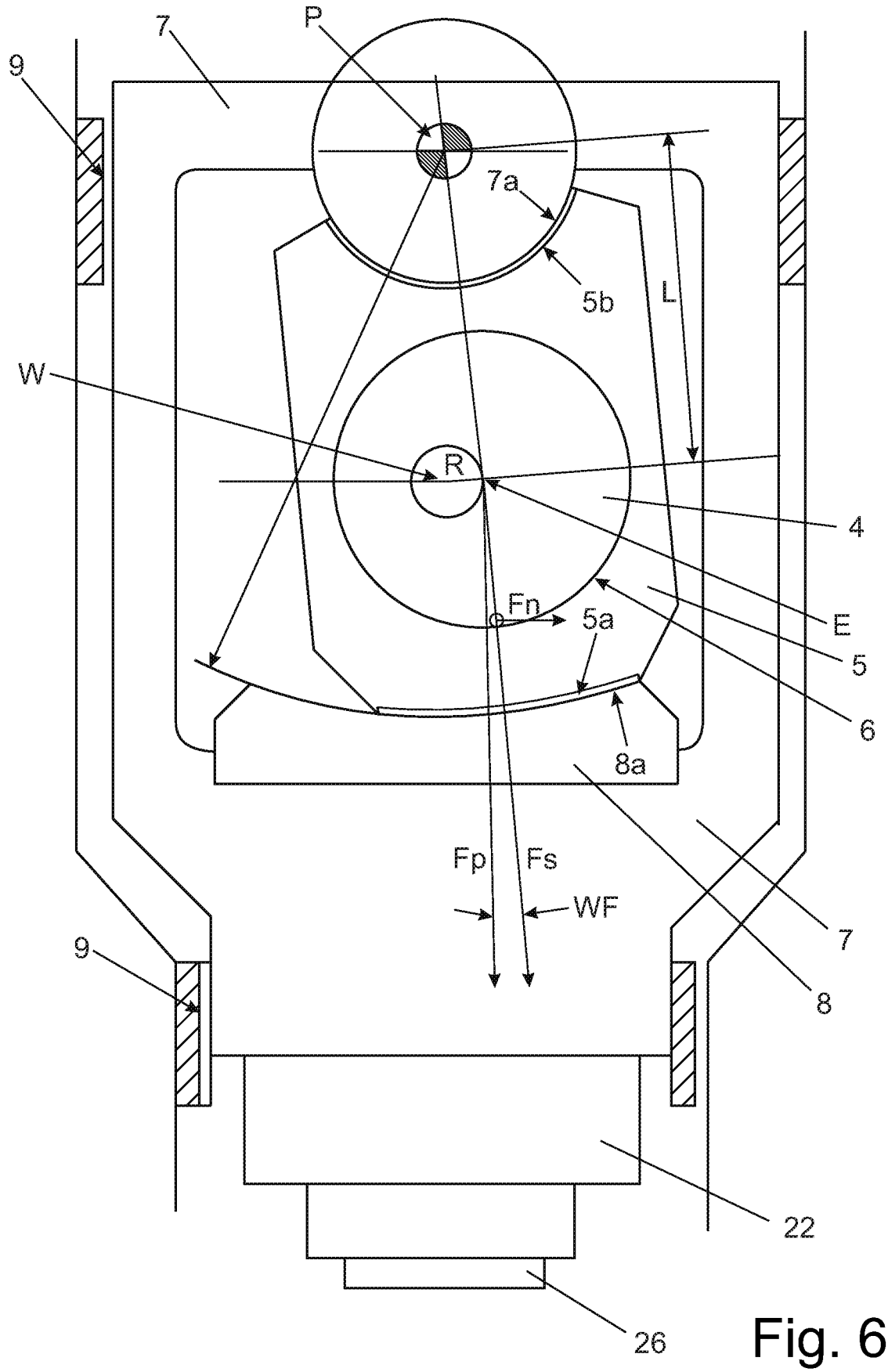
FIG. 6 shows a sketch of a third exemplary embodiment of the invention, where another variant of the sliding block is present with convex sliding surface at the pressure-input side.

In the exemplary embodiment of the invention shown in FIG. 6, the sliding block is shaped according to a second variant. Here, the pressure-input-side sliding surface 5*a* on the sliding block 5 is convex in shape, by contrast with the concave shape in the previously described examples.

The pressure-output-side sliding surface 5*b* is likewise formed on the sliding block 5 as the opposite of the preceding examples, i.e., concave. The corresponding sliding surfaces 7*a*, 8*a* on the slide guide are accordingly likewise curved in the reverse way. The sliding surfaces 5*a*, 5*b*, 7*a*, 8*a* as in the first variant of FIG. 4 are each time formed as sections of a cylinder envelope surface, the cylinder axes running parallel to the shaft axis W. The sliding surfaces 5*a*, 5*b*, 7*a*, 8*a* in turn run concentrically about a pendulum axis P of the sliding block 5, parallel to the shaft axis W.

Thus, the pendulum axis P likewise lies outside the sliding block 5. Unlike the first variant, the pendulum axis P of the second variant lies on the pressure-output side with regard to the sliding block 5. For the sliding block 5, once again a forcibly guided pendulum movement about the pendulum axis P results upon rotation of the drive shaft 1.

The second variant also corresponds to an analogous slider crank mechanism with the characterizing quantities L (distance between pendulum axis P and shaft axis W) and R (distance between eccentric axis E and shaft axis W). Unlike with the first variant, however, the dead center of the working stroke corresponds to a coincident position of an analogous slider crank mechanism. That is, the distances R and L at the lowermost point of the tool lie collinear and one above the other.

Of course, other kinematics are also conceivable, such as eccentric slider crank mechanisms with a configuration of the sliding block according to the invention.

Figure 7:
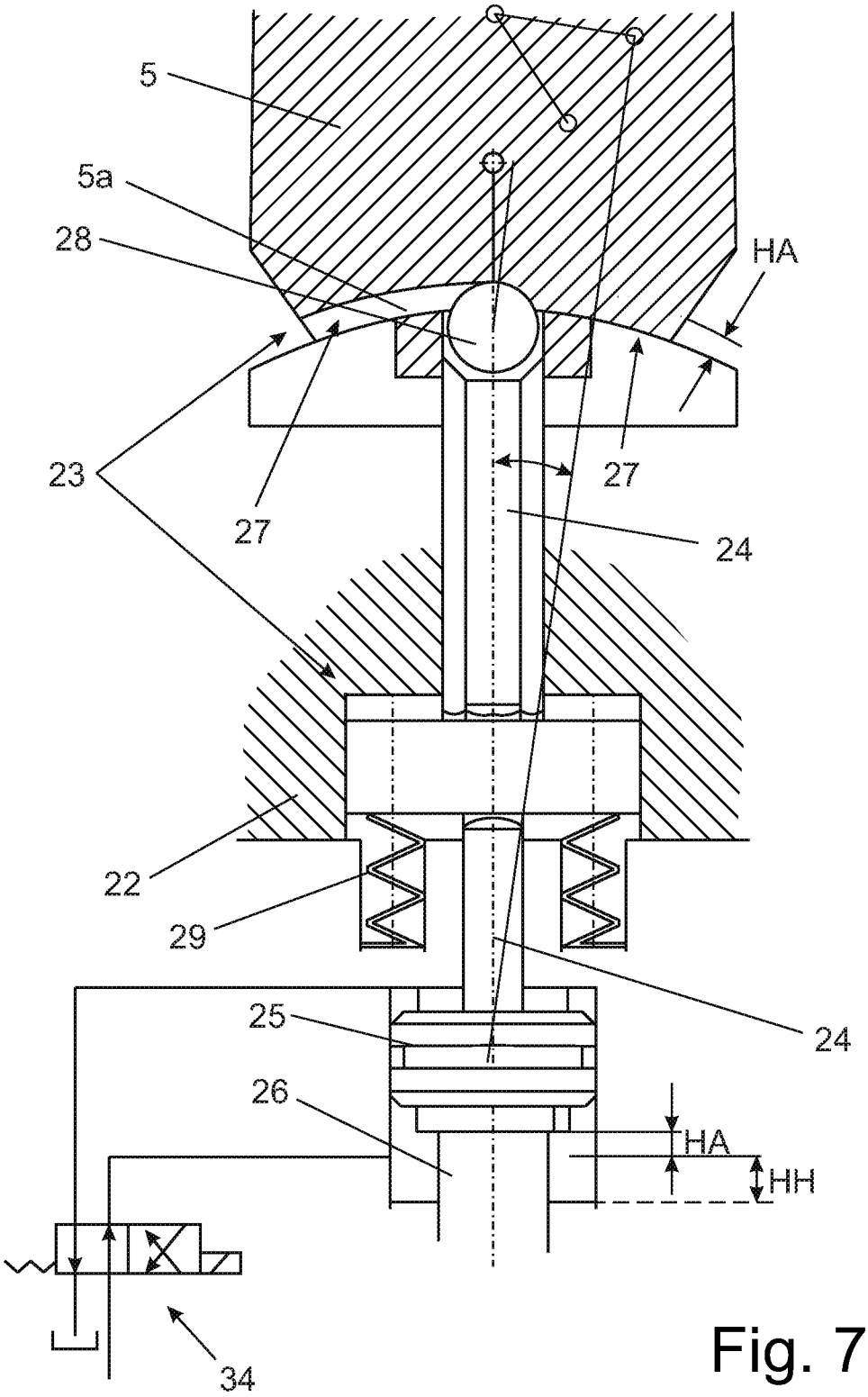
FIG. 7 shows a sketch of a fourth exemplary embodiment, in which an ejecting mechanism is coupled to a sliding block drive.

In the exemplary embodiment shown in FIG. 7, an ejecting mechanism 23 is integrated into the press, being activated by means of the motion of the sliding block. The ejecting mechanism comprises an ejector 24, which travels in a guide of the ram 22 able to move in linear fashion and able to press against a workpiece (not shown) at the lower end of the ram.

After a pressing process, the ejector 24 is displaced by means of a mechanical forced guidance against the workpiece, ejecting the workpiece from a tool (not shown). In this way, a reliable change of workpiece is made possible in a simple way.

The activating of the ejector 24 takes place by means of a ramp 27 on the sliding block 5. The ramp 27 lies against a head 28 of the ejector 24, being formed as a sphere in the present instance. The sliding block executes its pendulum movement about the pendulum axis P, sliding along the pressure-input-side sliding surfaces 5*a*, 8*a*. In this case, at first the ejector 24 is situated in a retracted position in which it does not press against the workpiece, by means of a spring 29.

After moving through the working stroke or the pressing process, the ramp 27 begins to press in the ejector 24 via the sphere 28. FIG. 7 shows roughly the starting time of this ejection process, the sliding block 5 being in the middle position and the ram 22 in a bottom dead center.

After this, the sliding block 5 moves further to the left in the representation of FIG. 7 and the ramp 27 moves the ejector 24 relative to the ram 22 or to the slide guide 7 against the workpiece. The ejector 24 in this process executes a movement by a stroke HA against the force of the spring 29.

In the present case, the ejector mechanism is illustrated with the aid of the first variant of the sliding block 5 with pressure-input-side concave sliding surface 5*a*. Especially preferred, the ejector mechanism may also be combined with the second variant of the sliding block 5 with pressure-input-side convex sliding surface 5*a*. This has the advantage that the linear path of the sliding block 5 along the sliding surface 5*a* is greater, with otherwise the same dimensioning of the press, which permits a less rigid design of the ramp 27.

By arranging a hydraulic piston 25 having a piston rod 26 in between, the stroke HA of the mechanical ejector 23, 24 can be increased. This means that the large force needed for the ejecting is provided by the mechanical ejector with the small stroke HA. The hydraulic piston increases the stroke HA by the stroke HH. The hydraulic piston 25 is operated via a valve with hydraulic actuation 34.

Figure 8:
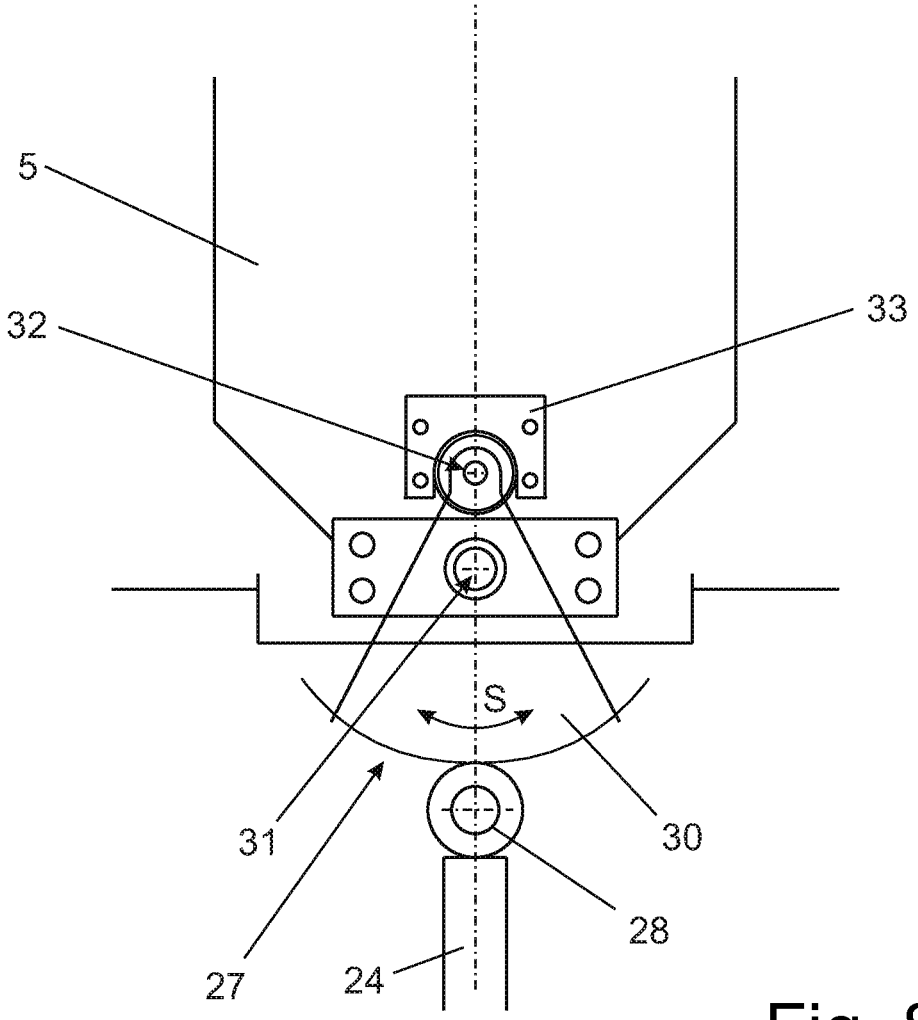
FIG. 8 shows a sketch of a fifth exemplary embodiment, in which an ejecting mechanism comprises a gearing.

The example of FIG. 8 shows an enhancement of the ejector mechanism 23, in which a gearing 30 is arranged between the sliding block 5 and the ejector 24.

In the present instance, the gearing 30 is shaped as a deflecting lever, mounted in a rotary bearing or swivel bearing 31 on the slide guide 7. The sliding block 5 is connected in a rotary bearing 32 to the deflecting lever, the pivot point of the rotary bearing 32 being flush with the sliding surface 5*a*. The rotary bearing 32 may also be fashioned as a cam roller. The swivel movement of the deflecting lever then takes place forcibly controlled by the cam roller 32 by the cassette guide 33 arranged on the sliding block 5.

On the deflecting lever 30, lying opposite to the rotary bearing 32, there is formed a ramp 27, which engages with the ejector 24 as in the previous example. The deflecting lever, in particular, makes possible a longer ramp for better actuating of the ejector 24.

Of course, the specific features of the preceding exemplary embodiments may be combined with each other as required.

The invention claimed is:

1. A mechanical press, comprising:

at least one drive shaft having a driver that is eccentric relative to a shaft axis, and a sliding block, wherein the sliding block is driven by the driver to perform a forcibly guided movement, wherein, during an execution of a pressure stroke, the sliding block is guided on at least one sliding surface on a pressure-input side opposite to a pressure-input-side surface of a slide guide, wherein the sliding block has a sliding surface on a pressure-output side lying opposite the pressure-input side sliding surface, the sliding surface on the pressure-output side being guided at a pressure-output-side surface of the slide guide, wherein the sliding surface on the pressure-input side of the sliding block has a concave or convex curvature, wherein the sliding surface on the pressure-output side of the sliding block has the opposite concave or convex curvature, respectively, and wherein an ejecting mechanism is provided, which is taken up fixed in place opposite to the slide guide, having an ejector that is movable opposite to the slide guide and acts on a workpiece, wherein the ejecting mechanism is activated by the movement of the sliding block, wherein a drive system of the drive shaft comprises a first motor, a flywheel drivable by the first motor, and a second motor.

2. The mechanical press as claimed in claim 1, wherein the sliding block executes a pendulum movement about a pendulum axis, wherein the pendulum axis is situated outside the sliding block.

3. The mechanical press as claimed in claim 2, wherein the driver travels about an eccentric axis in the sliding block, wherein the eccentric axis has a spacing R relative to the shaft axis, while the eccentric axis has a spacing L relative to the pendulum axis, and wherein: L:R >=4.

4. The mechanical press as claimed in claim 1, wherein an adjusting element in the form of an adjustably rotatable eccentric ring is arranged between the driver and the sliding block.

5. The mechanical press as claimed in claim 1, wherein a pressure piece is moved during the pressure stroke in a line with a ram of the press.

6. The mechanical press as claimed in claim 5, wherein a force deflection, by a wedge, takes place between the pressure piece and the ram of the press.

7. The mechanical press as claimed in claim 1, wherein a gearing is arranged between the sliding block and the ejector.

8. The mechanical press as claimed in claim 1, wherein the first motor and the flywheel are arranged coaxially to one another and are integrated as a structural unit in a flywheel motor.

9. The mechanical press as claimed in claim 1, wherein the flywheel can be coupled up to the drive shaft without gearing and wherein the flywheel is arranged concentric to the drive shaft.

10. The mechanical press as claimed in claim 1, wherein the second motor is designed as a torque motor arranged concentric to the drive shaft.

11. The mechanical press as claimed in claim 10, wherein a brake of the drive shaft is provided, being concentric to the torque motor and overlapping in an axial direction with the torque motor.

12. The mechanical press as claimed in claim 1, wherein the drive shaft, starting from a resting start position, travels through an angle of rotation of more than 360° by way of a pressure stroke up to a resting stop position.

13. The mechanical press as claimed in claim 3, wherein 12 >=L:R >=5.

14. The mechanical press as claimed in claim 12, wherein the drive shaft, starting from a resting start position, travels through an angle of rotation between 370° and 450°, by way of the pressure stroke up to the resting stop position.

15. The mechanical press as claimed in claim 1, wherein the flywheel can be detachably coupled to the drive shaft by means of a coupling, and wherein the drive shaft can be driven via the second motor.

16. The mechanical press as claimed in claim 15, wherein the coupling is engaged in a normal operation when a drive-side and an output-side rotational speed at the coupling are at least approximately equal, wherein an equalizing of the rotational speeds is produced by a targeted actuation of the second motor.

17. A mechanical press, comprising:

at least one drive shaft having a driver that is eccentric relative to a shaft axis, and a sliding block, wherein the sliding block is driven by the driver to perform a forcibly guided movement, wherein, during an execution of a pressure stroke, the sliding block is guided on at least one sliding surface on a pressure-input side opposite to a pressure-input-side surface of a slide guide, wherein the sliding block has a sliding surface on a pressure-output side lying opposite the pressure-input side sliding surface, the sliding surface on the pressure-output side being guided at a pressure-output-side surface of the slide guide, wherein the sliding surface on the pressure-input side of the sliding block has a concave or convex curvature, wherein the sliding surface on the pressure-output side of the sliding block has the opposite concave or convex curvature, respectively, wherein a drive system of the drive shaft comprises a first motor, a flywheel drivable by the first motor, and a second motor, wherein the flywheel can be detachably coupled to the drive shaft by means of a coupling, and wherein the drive shaft can be driven via the second motor, and wherein the coupling is engaged in a normal operation when a drive-side and an output-side rotational speed at the coupling are at least approximately equal, wherein an equalizing of the rotational speeds is produced by a targeted actuation of the second motor, wherein a pressure piece is moved during the pressure stroke in a line with a ram of the press, and wherein a force deflection, by a wedge, takes place between the pressure piece and the ram of the press.

* * * * *